US011200843B2

(12) United States Patent
Yang et al.

(10) Patent No.: US 11,200,843 B2
(45) Date of Patent: Dec. 14, 2021

(54) COMPENSATION CIRCUIT AND METHOD FOR CONTROLLING THE SAME, DISPLAY PANEL AND DISPLAY DEVICE

(71) Applicant: BOE TECHNOLOGY GROUP CO., LTD., Beijing (CN)

(72) Inventors: Fei Yang, Beijing (CN); Song Meng, Beijing (CN); Yue Wu, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 166 days.

(21) Appl. No.: 16/146,425

(22) Filed: Sep. 28, 2018

(65) Prior Publication Data

US 2019/0103059 A1 Apr. 4, 2019

(30) Foreign Application Priority Data

Sep. 29, 2017 (CN) ..... 201710908864.7

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/043* (2013.01);
(Continued)

(58) Field of Classification Search
CPC ..... G09G 3/3233; G09G 3/3258; G09G 2300/043; G09G 2300/0819;
(Continued)

(56) References Cited

U.S. PATENT DOCUMENTS

2009/0121980 A1* 5/2009 Kawasaki ..... G09G 3/3283 345/76
2014/0152643 A1* 6/2014 Kim ..... G09G 3/3258 345/212

(Continued)

FOREIGN PATENT DOCUMENTS

CN 101697268 A 4/2010
CN 103871362 A 6/2014

(Continued)

OTHER PUBLICATIONS

Chinese Office Action dated Apr. 8, 2019, from application No. 201710908864.7.

(Continued)

*Primary Examiner* — Antonio Xavier
(74) *Attorney, Agent, or Firm* — Thomas | Horstemeyer, LLP

(57) ABSTRACT

The present disclosure relates to a compensation circuit and a method for controlling the same, a display panel and a display device. The compensation circuit includes a sensing line for receiving a current from the source to the drain of the first transistor The compensation circuit includes a first switch having a terminal electrically connected to the sensing line. The compensation circuit includes a current sensor electrically connected to another terminal of the first switch and configured to determine a value of a current on the sensing line when the first transistor is turned on and the first switch is closed The compensation circuit includes a controller electrically connected to the current sensor and the data line for adjusting a data signal input to the data line according to the value of the current.

14 Claims, 10 Drawing Sheets

(52) U.S. Cl.
CPC ..... *G09G 2300/0819* (2013.01); *G09G 2300/0842* (2013.01); *G09G 2320/0295* (2013.01); *G09G 2320/0693* (2013.01)

(58) Field of Classification Search
CPC ... G09G 2300/0842; G09G 2320/0295; G09G 2320/0693; G09G 2320/045
See application file for complete search history.

(56) References Cited

U.S. PATENT DOCUMENTS

2014/0252988 A1* 9/2014 Azizi ..... H05B 45/14 315/307
2014/0375533 A1* 12/2014 Kim ..... G09G 3/3233 345/78
2015/0170571 A1* 6/2015 Park ..... G09G 3/3266 345/690
2015/0187271 A1* 7/2015 Bae ..... G09G 3/3291 345/690
2016/0012799 A1 1/2016 Kim
2016/0125811 A1* 5/2016 Park ..... G09G 3/3258 345/694
2016/0140901 A1* 5/2016 Bae ..... G09G 3/3233 345/212
2016/0267842 A1* 9/2016 Zhang ..... G09G 3/3233
2017/0039952 A1* 2/2017 Kim ..... G09G 3/3233
2017/0148385 A1* 5/2017 Kishi ..... G09G 3/3283
2017/0162122 A1* 6/2017 In ..... G09G 3/3266
2017/0347098 A1* 11/2017 Gilmutdinov ..... H04N 19/124
2018/0033374 A1* 2/2018 Jeong ..... G09G 3/3618
2018/0053462 A1* 2/2018 Bae ..... G09G 3/2074
2018/0114485 A1* 4/2018 Kim ..... H01L 27/3276
2018/0122883 A1* 5/2018 Beak ..... H01L 27/3258
2018/0151599 A1* 5/2018 Cho ..... H01L 27/3276
2018/0190730 A1* 7/2018 Cho ..... H01L 51/5203
2019/0035331 A1* 1/2019 Do ..... G09G 3/3413
2019/0103456 A1* 4/2019 Choi ..... H01L 27/3276

FOREIGN PATENT DOCUMENTS

CN 104424893 A 3/2015
CN 105702209 A 6/2016
CN 105895007 A 8/2016
CN 106057130 A 10/2016
CN 106205496 A 12/2016
CN 106847171 A 6/2017

OTHER PUBLICATIONS

Chinese Office Action dated Apr. 9, 2020, from application No. 201710908864.7.

* cited by examiner

COMPENSATION CIRCUIT AND METHOD FOR CONTROLLING THE SAME, DISPLAY PANEL AND DISPLAY DEVICE

CROSS-REFERENCE TO RELATED APPLICATIONS

This application claims priority to Chinese Patent Application 201710908864.7, filed Sep. 29, 2017, the entire contents of which are incorporated herein by reference.

TECHNICAL FIELD

The present disclosure relates to display technologies, and particularly to a compensation circuit, a display panel, a display device and a method for controlling the compensation circuit.

BACKGROUND

At present, current compensation for an Organic Light-Emitting Diode (OLED) mainly uses a sensing line for sensing and receiving a voltage signal of a driver transistor, and uses a switch to be connected to the sensing line. In a non-display phase, (for example, a sense phase), by closing the switch, the voltage signal on the sensing line is transmitted to a timing controller through the switch, so that the timing controller determines the change of the threshold voltage Vth of the driver transistor, thus adjusting the data signal strength to make compensation.

In this method, the specific compensation value is determined only based on the voltage signal on the sensing line. However, the compensation value obtained only by measuring the voltage signal on the sensing line is not accurate.

SUMMARY

Arrangements of the present disclosure provides a compensation circuit, a display panel, a display device and a method for controlling the compensation circuit, so as to solve the problems in the related art.

According to a first aspect of arrangements of the present disclosure, there is provided a compensation circuit, applicable for a display panel including a plurality of pixels, each pixel including a plurality of sub-pixels.

Each sub-pixel includes a first transistor. A gate of the first transistor is electrically connected to a data line, a source of the first transistor is electrically connected to a voltage input end, and a drain of the first transistor is electrically connected to an organic light emitting element. The compensation circuit includes a sensing line for receiving a current flowing from the source to the drain of the first transistor. The compensation circuit includes a first switch having a terminal electrically connected to the sensing line. The compensation circuit includes a current sensor electrically connected to another terminal of the first switch and configured to determine a value of the current on the sensing line when the first transistor is turned on and the first switch is closed. The compensation circuit includes a controller electrically connected to the current sensor and the data line for adjusting a data signal input to the data line according to the value of the current.

According to an exemplary arrangement, each sub-pixel further includes a second transistor. A gate of the second transistor is electrically connected to a first gate line, a source of the second transistor is electrically connected to the data line, and a drain of the second transistor is electrically connected to a connection node where the organic light emitting element is connected to a capacitor. The capacitor is connected between the gate and drain of the first transistor.

Each sub-pixel further includes a third transistor. A gate of the third transistor is electrically connected to a second gate line, a source of the third transistor is electrically connected to the gate of the second transistor.

The sensing line is electrically connected to a drain of the third transistor.

According to an exemplary arrangement, the compensation circuit further includes a storage device electrically connected to the controller for storing a theoretical value of a current on the sensing line when the organic light emitting element emits light.

The controller is configured to adjust the data signal input to the data line according to a relationship between the value of the current and the theoretical value.

According to an exemplary arrangement, the controller is configured to adjust the data signal into a product of the data signal and an adjustment coefficient.

If the value of the current is greater than the theoretical value, the adjustment coefficient is determined as smaller than 1. If the value of the current is smaller than the theoretical value, the adjustment coefficient is determined as greater than 1. If the value of the current is equal to the theoretical value, the coefficient is determined as equal to 1.

According to an exemplary arrangement, the adjustment coefficient is equal to a ratio of the theoretical value to the value of the current.

According to an exemplary arrangement, the compensation circuit includes a plurality of the sensing lines. Each of the sensing lines corresponds to a column of the sub-pixels and is configured to receive a current from the source to the drain of the first transistor in any one of the sub-pixels in a corresponding column of sub-pixels.

The current sensor is electrically connected to each of the sub-pixels for determining a total of currents from sources to drains of first transistors of all sub-pixels in the display panel received by the sensing lines in an n-th frame, where n is an integer greater than or equal to one.

According to an exemplary arrangement, the controller is configured to adjust the data signal input to the data line in a (n+1)-th frame according to the total of currents.

According to an exemplary arrangement, the compensation circuit includes a plurality of the sensing lines, each of the sensing lines corresponds to a column of the sub-pixels and is configured to receive a current from the source to the drain of the first transistor in any one of the sub-pixels in a corresponding column of sub-pixels.

The current sensor is electrically connected to each of the sub-pixels for determining a total of currents from sources to drains of first transistors in a t-th row of sub-pixels in the display panel received by the sensing lines in an s-th frame, where each oft and s is an integer greater than or equal to one.

According to an exemplary arrangement, the controller is configured to, according to the total of the currents, adjust the data signal input to the data line when the data signal is input to the t-th row of sub-pixels in a (s+1)-th frame.

According to an exemplary arrangement, the controller is configured to, according to the total of the currents, adjusting the data signal input to the data line when the data signal is input to a (t+1)-th row of sub-pixels in the s-th frame.

According to an exemplary arrangement, the compensation circuit further includes a reference voltage input terminal electrically connected to the current sensor for inputting a reference voltage to the current sensor.

According to an exemplary arrangement, the compensation circuit further includes a second switch electrically connected to the sensing line. The compensation circuit further includes an analog-to-digital converter electrically connected to the second switch. When the second switch is closed, the analog-to-digital converter acquires a voltage on the sensing line, and converts the voltage into a data voltage value.

The controller is further electrically connected to the analog-to-digital converter, and is configured to adjust the data signal input to the data line according to the data voltage value and the value of the current.

According to a second aspect of arrangements of the present disclosure, there is provided a display panel including the compensation circuit as described above.

According to a third aspect of arrangements of the present disclosure, there is provided a display device including the display panel as described above.

According to a fourth aspect of arrangements of the present disclosure, there is provided a method for controlling the compensation circuit as described above. The method includes determining a value of a current on the sensing line when the first transistor is turned on and the first switch is closed. The method includes adjusting a data signal input to the data line according to the value of the current.

According to an exemplary arrangement, the method further includes storing a theoretical value of a current on the sensing line when the organic light emitting element emits light. Adjusting a data signal input to the data line according to the value of the current includes adjusting the data signal input to the data line according to a relationship between the value of the current and the theoretical value.

According to an exemplary arrangement, the adjusting the data signal input to the data line includes adjusting the data signal into a product of the data signal and an adjustment coefficient. If the value of the current is greater than the theoretical value, the adjustment coefficient is determined as smaller than 1. If the value of the current is smaller than the theoretical value, the adjustment coefficient is determined as greater than 1. If the value of the current is equal to the theoretical value, the coefficient is determined as equal to 1.

According to an exemplary arrangement, the adjustment coefficient is equal to a ratio of the theoretical value to the value of the current.

According to an exemplary arrangement, the compensation circuit includes s a plurality of the sensing lines, each of the sensing lines corresponds to a column of the sub-pixels and is configured to receive a current from the source to the drain of the first transistor in any one of the sub-pixels in a corresponding column of sub-pixels.

The determining the value of the current on the sensing line includes determining a total of currents from sources to drains of first transistors of all sub-pixels in the display panel received by the sensing lines in an n-th frame, where n is an integer greater than or equal to one.

According to an exemplary arrangement, the adjusting a data signal input to the data line according to the value of the current includes according to the total of the currents, adjusting the data signal input to the data line in an (n+1)-th frame.

According to an exemplary arrangement, the compensation circuit includes a plurality of the sensing lines. Each of the sensing lines corresponds to a column of the sub-pixels and is configured to receive a current from the source to the drain of the first transistor in any one of the sub-pixels in a corresponding column of sub-pixels.

The determining the value of the current on the sensing line includes determining a total of currents from sources to drains of first transistors in a t-th row of sub-pixels in the display panel received by the sensing lines in an s-th frame, where each of t and s is an integer greater than or equal to one.

According to an exemplary arrangement, the adjusting a data signal input to the data line according to the value of the current includes according to the total of the currents, adjusting the data signal input to the data line when the data signal is input to the t-th row of sub-pixels in a (s+1)-th frame.

According to an exemplary arrangement, the adjusting a data signal input to the data line according to the value of the current includes according to the total of the currents, adjusting the data signal input to the data line when the data signal is input to a (t+1)-th row of sub-pixels in the s-th frame.

According to an exemplary arrangement, the compensation circuit further includes a second switch which is electrically connected to the sensing line. The method includes acquiring a voltage on the sensing line, and converting the voltage into a data voltage value.

The adjusting a data signal input to the data line according to the value of the current includes adjusting the data signal input to the data line according to the data voltage value and the value of the current.

It should be understood that the above general description and the following detailed description are illustrative but not restrictive.

BRIEF DESCRIPTION OF THE DRAWINGS

The accompanying drawings, which constitute a part of the description, show arrangements in compliance with the spirit of the present disclosure, and are provided to explain the principle of the present disclosure in conjunction with the description.

DETAILED DESCRIPTION

Exemplary arrangements will be described in detail herein, examples of which are illustrated in the accompanying drawings. In the following descriptions regarding drawings, the same or similar elements in different figures indicate the same or similar elements, unless otherwise indicated. The arrangements described in the following exemplary arrangements do not represent all arrangements consistent with the present disclosure. Instead, they are merely examples of devices and methods consistent with aspects of the present disclosure as detailed in the descriptions and appended claims.

Figure 1:
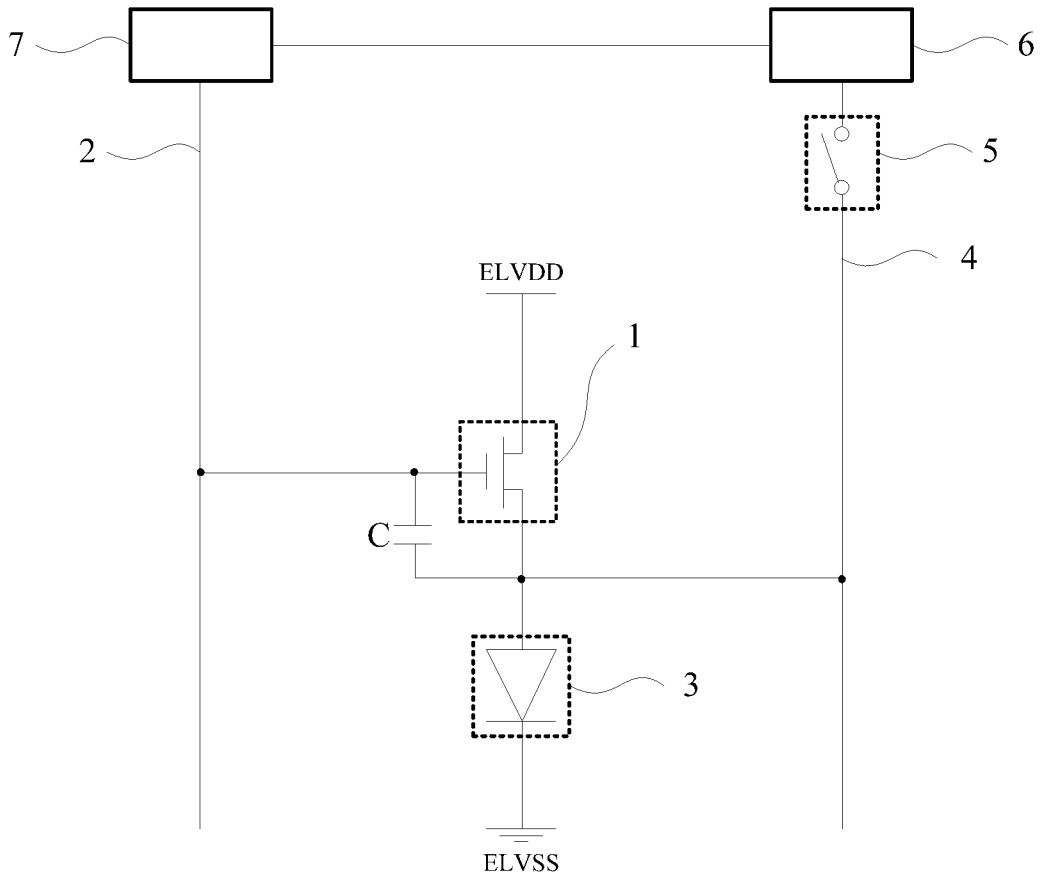
FIG. 1 is a schematic structural diagram of a compensation circuit according to an arrangement of the present disclosure.

FIG. 1 is a schematic structural diagram of a compensation circuit according to an arrangement of the present disclosure. The compensation circuit shown in this arrangement may be applicable to a display panel, such as an organic light emitting diode display panel. The display panel includes a plurality of pixels, each pixel includes a plurality of sub-pixels, and each of the sub-pixels includes a first transistor 1.

A gate of the first transistor 1 is electrically connected to a data line 2, a source of the first transistor 1 is electrically connected to a voltage input terminal ELVDD, and a drain of the first transistor 1 is electrically connected to an organic light-emitting element 3.

In one arrangement, the organic light emitting element may be an organic light emitting diode. One terminal of the organic light emitting element may be electrically connected to the drain of the first transistor, and the other terminal of the organic light emitting element may be electrically connected to a low voltage terminal ELVSS. The low voltage terminal ELVSS is generally used in conjunction with the voltage input terminal ELVDD. The voltage input to the ELVSS is lower than that input to the ELVDD.

In one arrangement, a capacitor C may also be provided between the gate and the drain of the first transistor to maintain the voltage between the source and drain of the first transistor.

The compensation circuit includes a sensing line 4, a first switch 5, a current sensor 6 and a controller 7 (the controller 7 may be a timing controller, for example).

The sensing line 4 is configured to receive a current from the source to the drain in the first transistor 1.

One terminal of the first switch 5 is electrically connected to the sensing line 4.

The current sensor 6 is electrically connected to the other end of the first switch 5, and is configured to determine the value of the current on the sensing line 4 when the first transistor 1 is turned on and the first switch 5 is closed. The current sensor can be an electronic component capable of detecting current, such as a Hall current sensor, a current transformer, or the like.

Figure 8:
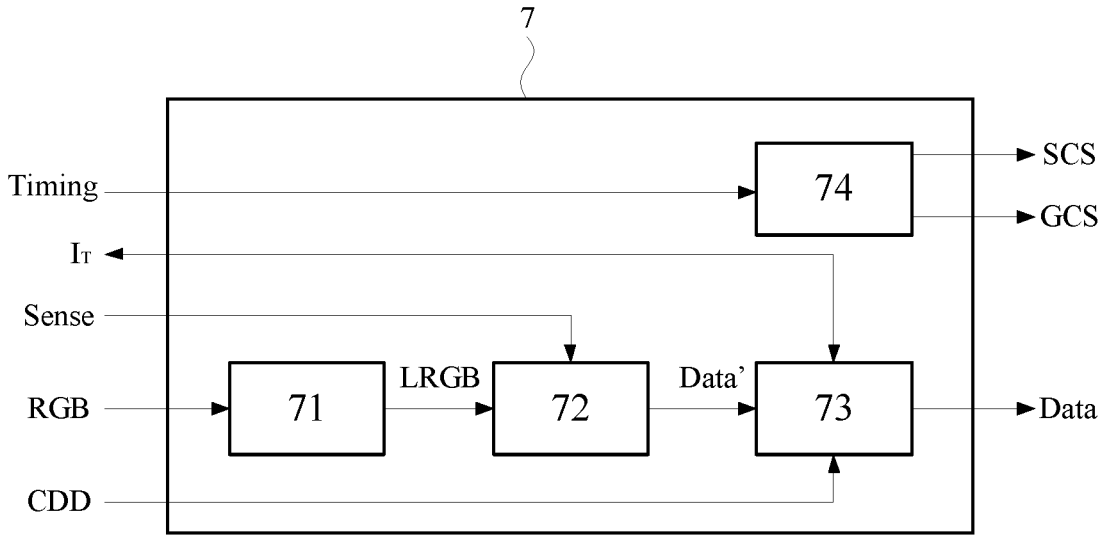
FIG. 8 is a schematic structural diagram of a timing controller according to an arrangement of the present disclosure.

The controller 7 may be a timing controller, for example. The controller 7 is electrically connected to the current sensor 6 and the data line 2, and is configured to adjust a data signal input to the data line 2 according to the sensed value of the current. The timing controller can receive the signal from the sensing line through the current sensor, and can also input a data signal to the data line, and can input a gate control signal a the gate line. The specific structure of the timing controller is explained in one arrangement, as shown in FIG. 8.

In one arrangement, in the case where the threshold voltage Vth of the first transistor changes, the voltage drop variation from the source to the drain of the first transistor is small, such that the magnitude of the voltage change on the sensing line is also small. However, due to the change in the threshold voltage Vth, for example, a decrease in the threshold voltage Vth causes an increase in the current from the source to the drain of the first transistor, and an increase in the current causes the temperature of the first transistor to rise, thus further causing the threshold voltage Vth to decrease. Accordingly, the current from the source to the drain in the first transistor is increased, that is, the magnitude of the current change on the sensing line is larger than the magnitude of the voltage change on the sensing line.

Therefore, the current sensor is set to determine the value of the current on the sensing line, thus enabling the timing controller to adjust the magnitude of the data signal input to the data line according to the value of the current. In this way, compensation for the variation of the threshold voltage Vth of the first transistor can be realized. In related art, the compensation value is calculated according to the voltage value on the sensing line. Since the magnitude of the current change on the sensing line is larger than the magnitude of the voltage change on the sensing line, the magnitude of the changes in the compensation value calculated according to the current on the sensing line is greater than the magnitude of the changes in the compensation value calculated according to the voltage on the sensing line. Thus, it is easier to adjust the compensation value more accurately in a relatively large extent of variation.

Figure 2:
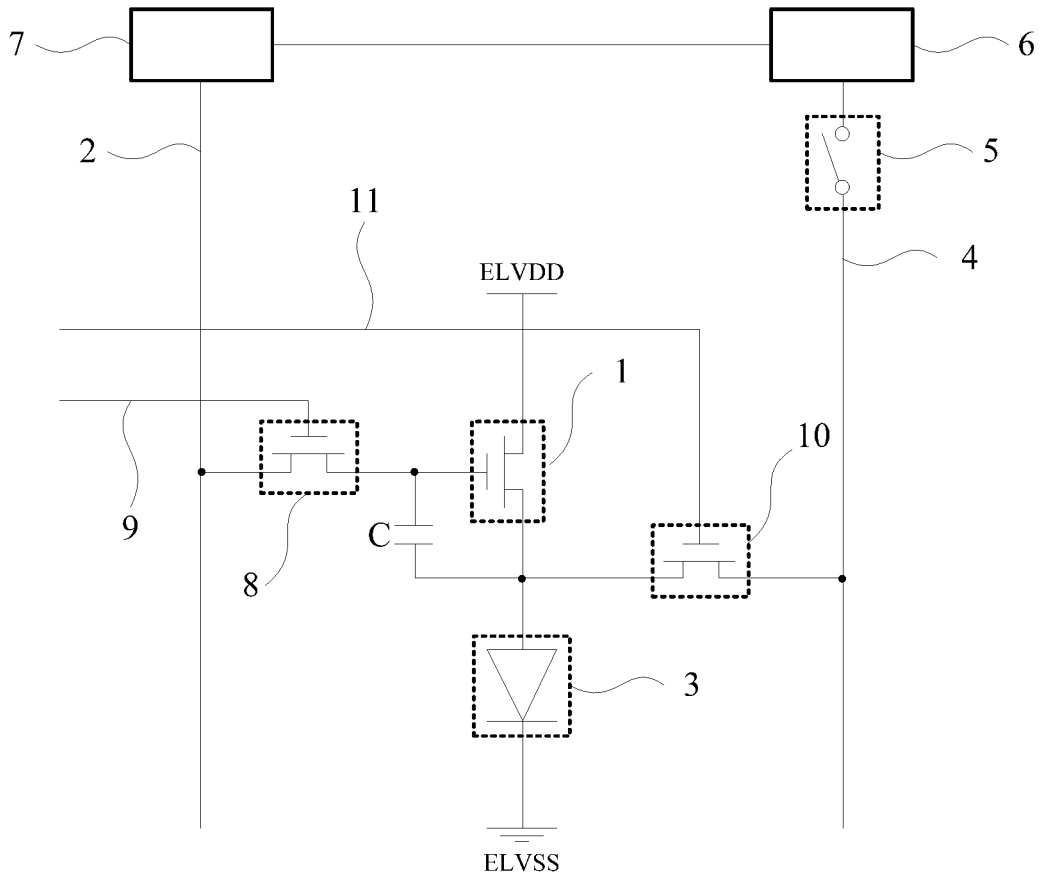
FIG. 2 is a schematic block diagram of a compensation circuit according to an arrangement of the present disclosure.

FIG. 2 is a schematic block diagram of a compensation circuit according to an arrangement of the present disclosure. As shown in FIG. 2, on the basis of the arrangement shown in FIG. 1, the sub-pixel further includes a second transistor 8 and a third transistor 10.

A gate of the second transistor 8 is electrically connected to a first gate line 9, a source of the second transistor 8 is electrically connected to the data line 2, and a drain of the second transistor 8 is electrically connected to the gate of the first transistor 1.

A gate of the third transistor 10 is electrically connected to a second gate line 11 and a source of the third transistor 10 is electrically connected to a connection node where the organic light emitting element 3 is connected to the capacitor C.

The sensing line 4 is electrically connected to a drain of the third transistor 10.

In one arrangement, the gate of the first transistor can be electrically connected to the data line through the second transistor. Specifically, the second transistor can be controlled to be turned on by the first gate line, and the data signal on the data line is transmitted to the gate of the first transistor when the second transistor is turned on. The third transistor can be controlled to be turned on by the second gate line, and the current from the source to the drain of the first transistor can be transmitted to the sensing line through the third transistor when the third transistor is turned on. According to this, it is possible to conveniently control the conduction of the first transistor and to control the transmission of the current from the source to the drain of the first transistor to the sensing line.

Figure 3:
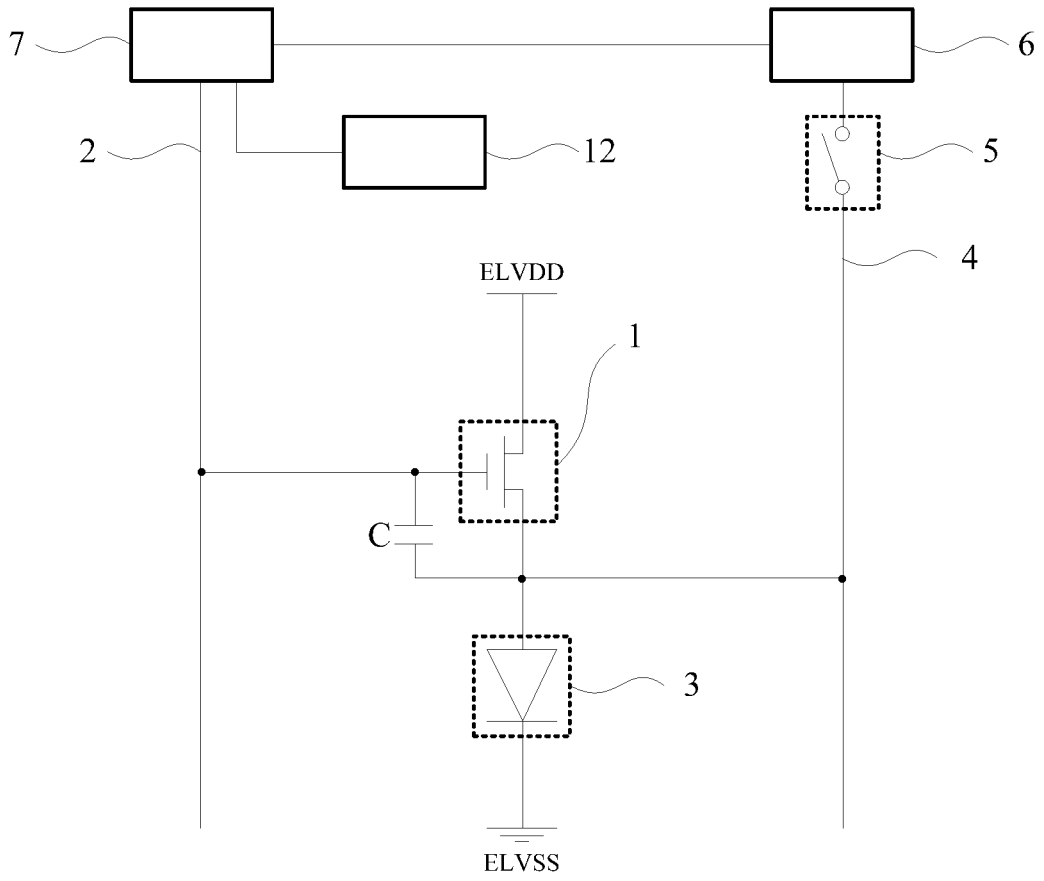
FIG. 3 is a schematic block diagram of a compensation circuit according to an arrangement of the present disclosure.

FIG. 3 is a schematic structural diagram of a compensation circuit according to an arrangement of the present disclosure. As shown in FIG. 3, on the basis of the arrangement shown in FIG. 1, the compensation circuit further includes a storage device 12.

The storage device 12 is electrically connected to the timing controller 7 and is configured to store a theoretical value of the current on the sensing line 4 when the organic light emitting element 3 emits light.

The timing controller 7 is configured to adjust the data signal input to the data line 2 according to a relationship between the value of the current and the theoretical value.

In one arrangement, the storage device can be a RAM. The theoretical value (that is, the current value flowing through the source and the drain of the first transistor in the case where the light emitting element normally emits light) of the current on the sensing line when the organic light-emitting element emits light may be pre-stored in the storage device. The current on the sensing line obtained by the timing controller through the current sensor is the value of the current flowing through the source and the drain of the first transistor during the actual light-emitting process of the light emitting element. According to a relationship between the value of the current and the theoretical value of the current (for example, the difference between the value of the current and the theoretical value), how to adjust the data signal input to the data line can be conveniently determined according to the difference to reduce or eliminate the difference.

According to an arrangement, the timing controller is configured to adjust the data signal to be a product of the data signal and an adjustment coefficient.

If the value of the current is greater than the theoretical value, the adjustment coefficient is determined as smaller than 1; if the value of the current is smaller than the theoretical value, the adjustment coefficient is determined as greater than 1; and if the value of the current is equal to the theoretical value, the coefficient is determined as equal to 1.

In one arrangement, if the value of the current is greater than the theoretical value, it indicates that the Vth of the first transistor is reduced, resulting in that an actual current flowing through the source and the drain of the first transistor is too large. Under such condition, data signal can be decreased so as to counteract the reduction in the Vth to some extent.

If the value of the current is smaller than the theoretical value, it means that the Vth of the first transistor becomes larger, resulting in that an actual current flowing through the source and the drain of the first transistor is too small. Under such condition, the data signal can be increased so as to counteract the rise in the Vth to some extent.

If the value of the current is equal to the theoretical value, it means that there is nearly no change in the Vth of the first transistor, it is not needed to adjust the data signal.

Since the value of the current is not completely equal to the theoretical value in general, if the absolute value of the difference between the value of the current and the theoretical value is smaller than a preset value (for example, 0.01 mA), the adjustment coefficient can be set as equal to 1.

According to an arrangement, the adjustment coefficient is equal to a ratio of the theoretical value to the value of the current.

In one arrangement, if the value $I_{DT}$ of the current is greater than the theoretical value $I_T$, the adjustment coefficient k is greater than 1; if the value $I_{DT}$ of the current is smaller than the theoretical value $I_T$, k is smaller than 1. The ratio $I_T/I_{DT}$ of the theoretical value and the value of the current can intuitively reflect the relationship between the theoretical value and the value of the current, so k is set as $k=I_T/I_{DT}$ to facilitate subsequent operations.

In one arrangement, if the data signal currently transmitted by the timing controller to the data line is Data, the adjusted data signal is Data'=k×Data, so that the data signal Data can be decreased or amplified according to the value of k to implement compensation to the threshold voltage Vth of the first transistor.

According to an exemplary arrangements, the compensation circuit includes a plurality of sensing lines (not shown). Each of the sensing lines corresponds to a column of the sub-pixels and is configured to receive a current from the source to the drain of the first transistor in any one of the sub-pixels in a corresponding column of sub-pixels.

The current sensor is electrically connected to each of the sub-pixels for determining a total of currents from sources to drains of first transistors of all sub-pixels in the display panel received by the sensing lines in an n-th frame, where n is an integer greater than or equal to one.

In one arrangement, a current sensor can be electrically connected to a plurality of sensing lines. For example, one current sensor can be disposed in a display panel, and the current sensor receives currents from the sources to the drains of the first transistors in each column of sub-pixels, and thus calculate the sum of the currents. Then, according to the sum of the currents, the data signal is adjusted. Since the sum of the values of the currents from the sources to the drains of the first transistors in the plurality of columns of sub-pixels is larger than the value of the current from the source to the drain of the first transistor in one sub-pixel, it is easier for the current sensor to sense the currents.

According to an exemplary arrangement, the timing controller is configured to adjust the data signal input to the data line in the (n+1)-th frame according to the sum of the currents.

In one arrangement, within the time period of one frame, for example, if the display panel is driven in a row-by-row scan manner, each time a row of sub-pixels is turned on, a data signal can be output to the row of turned-on sub-pixels, and the current sensor can receive the values CDD of the currents on the sensing lines corresponding to the row of turned-on sub-pixels. For example, the value of the current on the sensing line corresponding to the n-th row of sub-pixels is CDD(n). In the time period of one frame, the values of the currents on the sensing lines corresponding to all the sub-pixels in the display panel can be received, and the sum of the values of the currents on the sensing lines in the time period of one frame can be calculated as the $I_{DT}$ in the above arrangement, that is, $I_{DT}$=CDD (1)+CDD (2)+ . . . +CDD (n)+ . . . +CDD (N). The display panel has N rows of sub-pixels, 1<n<N, and n and N are integers.

In one arrangement, the $I_T$ in the above arrangement may be determined in the following manner. For example, when the display panel to which the compensation circuit is applied is shipped, the theoretical values of the currents on the corresponding sensing lines corresponding to sub-pixels of different colors in the full screen under different brightnesses can be recorded and stored.

Figure 4:
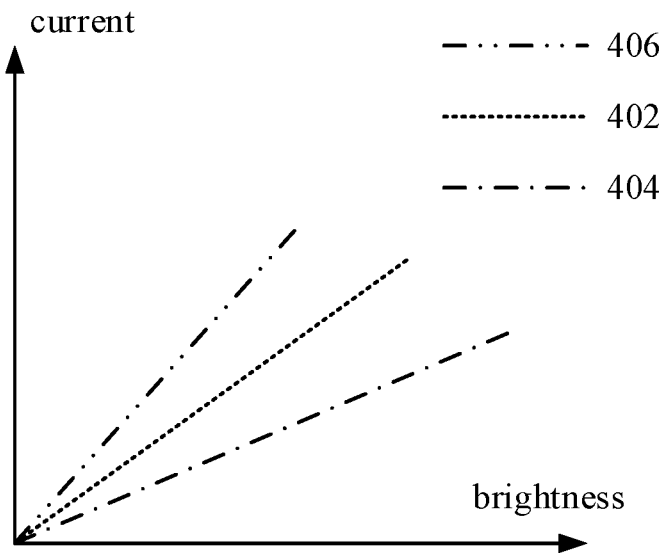
FIG. 4 is a schematic diagram showing a relationship between current and brightness according to an arrangement of the present disclosure.

FIG. 4 is a schematic diagram showing the relationship between current and brightness in accordance with an arrangement of the present disclosure.

Taking a display device including a red sub-pixel (R) 402, a green sub-pixel (G) 404, and a blue sub-pixel (B) 406 as an example, the full-screen red sub-pixel, the green sub-pixel, and the blue sub-pixel are measured at room temperature 25° C. The theoretical values of the currents on the induction line at different brightnesses, thus forming the relationships between the brightnesses of the red sub-pixels, the green sub-pixels, and the blue sub-pixels and the theoretical values of the currents on the corresponding sensing lines, as shown in FIG. 4.

In one frame time, the theoretical value $I_R$ of the current required by the red sub-pixels is determined according to the brightness value of the red sub-pixels in the frame and the relationship shown in FIG. 4. The theoretical value $I_G$ of the current required by the green sub-pixels is determined according to the brightness value of the green sub-pixels in the frame and the relationship shown in FIG. 4. The theoretical value $I_B$ of the current required by the blue sub-pixels is determined according to the brightness value of the blue sub-pixels in the frame and the relationship shown in FIG. 4. The theoretical value of the output current $I_T$ for the frame is $I_T=I_R+I_G\ I_B$.

In one arrangement, since the current sensor senses the sum of the source-to-drain currents of the first transistors in all the sub-pixels, each row of sub-pixels in the display panel needs to be scanned once to obtain the sum of the currents. That is, at least one frame time is required. Thus, in this case, the determined data signal adjustment strategy cannot be used to adjust the data signal in the current frame, and thus the adjustment strategy is used for the data signal in the next frame because the frame compensation in the next frame is most similar to the frame compensation of the current frame.

According to an exemplary arrangement, the compensation circuit includes a plurality of the sensing lines (not shown), each of the sensing lines corresponds to a column of the sub-pixels and is configured to receive a current from the source to the drain of the first transistor in any one of the sub-pixels in a corresponding column of sub-pixels.

The current sensor is electrically connected to each of the sub-pixels for determining a total of currents from sources to drains of first transistors in a t-th row of sub-pixels in the display panel received by the sensing lines in an s-th frame, where each of t and s is an integer greater than or equal to one.

In one arrangement, a current sensor can be electrically connected to a plurality of sensing lines. For example, one current sensor can be disposed in a display panel, and the current sensor receives currents from the sources to the drains of the first transistors in each column of sub-pixels, and thus calculate the sum of the currents. Then, according to the sum of the currents, the data signal is adjusted.

If the display panel is driven in a row-by-row scan manner, each time a row of sub-pixels is turned on, the current sensor can receive the values of the currents from the source to the drain of the first transistor in each sub-pixel in the row of sub-pixels, and thus obtain the sum of the currents from the sources to the drains of the first transistors in the row of sub-pixels. Then, the data signal can be adjusted according to the sum. As compared with the above arrangement in which how to adjust the data signal can be determined after rows of the sub-pixels in the display panel are scanned, the present arrangement can determine how to adjust the data signal after each row of the sub-pixels are scanned, and the determination speed is fast.

However, the manner of determining how to adjust the data signal in this arrangement is faster, but the algorithm is relatively complicated. In the above arrangement, after scanning the rows of sub-pixels in the display panel, it is determined how to adjust the data signal. Although the speed is relatively slow, the algorithm is relatively simple. Which determination manners should be selected to adjust the data signal can be determined depending on actual needs.

According to an exemplary arrangement, the timing controller is configured to adjust, according to the sum of the currents, the data signal input to the data line when the data signal is input to the t-th sub-pixel in the (s+1)-th frame.

In one arrangement, how to adjust the data signal can be determined after receiving the sum of the values of the currents flowing from the sources to the drains of the first transistors corresponding to the sub-pixels in a row of sub-pixels, rather than scanning all the rows of sub-pixels in the display panel. Thus, after determining the adjustment strategy for the data signal of a certain row of sub-pixels, since the row of sub-pixels has been turned on (that is, the data signal is input), the determined adjustment strategy can be applied to the row of sub-pixels in a next frame because the compensation of the row of the sub-pixels in the next frame is most similar to the row of sub-pixels in the current frame.

According to an exemplary arrangement, the timing controller is configured to adjust, according to the sum of the currents, the data signal input to the data line when the data signal is input to the (t+1)-th row of sub-pixels in the s-th frame.

In one arrangement, how to adjust the data signal can be determined after receiving the sum of the values of the currents flowing from the sources to the drains of the first transistors corresponding to the sub-pixels in a row of sub-pixels, rather than scanning all the rows of sub-pixels in the display panel. Thus, after determining the adjustment strategy for the data signal of a certain row of sub-pixels, since the row of sub-pixels has been turned on (that is, the data signal is input), the determined adjustment strategy can be applied to the a next row of sub-pixels in the same frame because the compensation of the next row of the sub-pixels in the current frame is most similar to the row of sub-pixels in the current frame.

The above arrangements show the case where the adjustment strategy for the data signal is applied to all the sub-pixels of the next frame, the case where the adjustment strategy for the data signal is applied to the same row of sub-pixels in the next frame, and the case where the adjustment strategy for the data signal is applied to the next row of sub-pixels in the current frame. Which cases should be used may be determined depending on actual needs.

Figure 5:
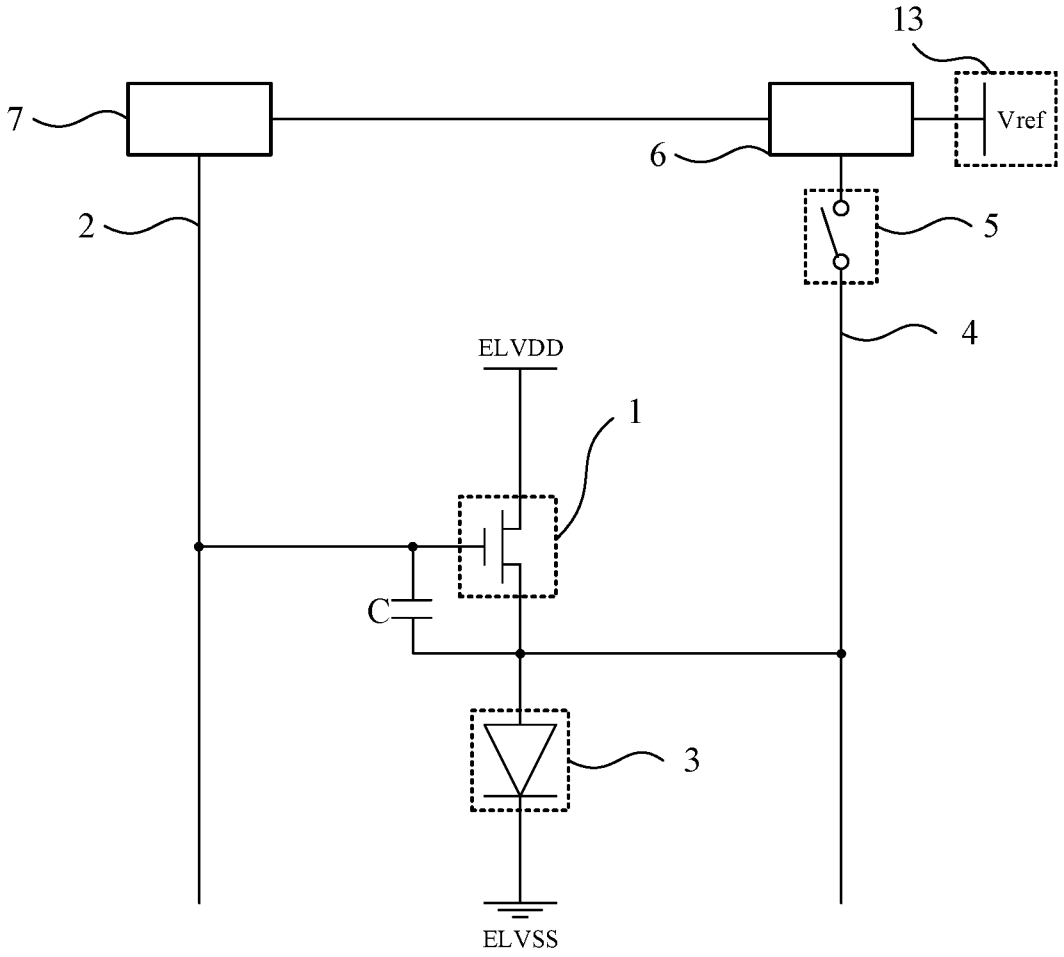
FIG. 5 is a schematic block diagram of a compensation circuit according to an arrangement of the present disclosure.

FIG. 5 is a schematic structural diagram of a compensation circuit according to an arrangement of the present disclosure. As shown in FIG. 5, on the basis of the arrangement shown in FIG. 1, the compensation circuit further includes a reference voltage input terminal 13.

The reference voltage input terminal 13 is electrically connected to the current sensor 6 for inputting a reference voltage to the current sensor 6.

In one arrangement, the reference voltage is input to the current sensor through the reference voltage input terminal, so that when a current flows through the sensing line, the voltage on the sensing line can be maintained at the reference voltage without changing with the current. Thus, in the case where the timing controller determines how to adjust the data signal (for example, calculating the adjustment coefficient according to the above arrangement), it is not necessary to consider the variation of the voltage on the sensing line, which is advantageous for simplifying the computational complexity of the timing controller.

Figure 6:
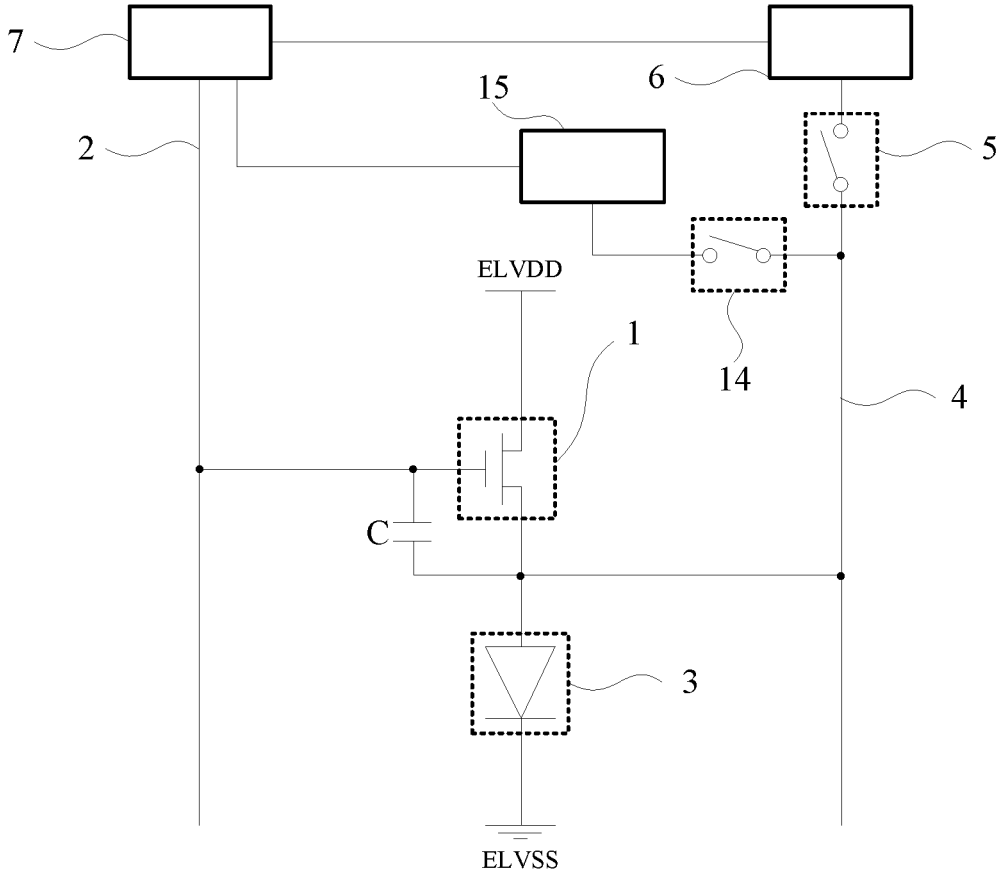
FIG. 6 is a schematic block diagram of a compensation circuit according to an arrangement of the present disclosure.

FIG. 6 is a schematic structural diagram of a compensation circuit according to an arrangement of the present disclosure. As shown in FIG. 6, on the basis of the arrangement shown in FIG. 1, the compensation circuit further includes a second switch 14 and an analog-to-digital converter 15.

The second switch 14 is electrically connected to the sensing line 4.

The analog-to-digital converter 15 is electrically connected to the second switch 14. When the second switch 14 is closed, the analog-to-digital converter 15 acquires a voltage on the sensing line 4, and converts the voltage into a data voltage value. The analog-to-digital converter may be an electronic component for converting an analog voltage signal into a digital voltage signal, and the type thereof may be selected according to requirements, such as an integral analog-to-digital converter, a parallel comparison analog-to-digital converter, a successive approximation analog-to-digital converter, and the like The timing controller 7 is further electrically connected to the analog-to-digital converter 15 for adjusting the data signal input to the data line according to the data voltage value and the value of the current.

In one arrangement, based on the value of the current on the sensing line, the value of the voltage on the sensing line can also be determined, and the data signal can be adjusted by considering the value of the voltage and the value of the current. For example, the adjustment coefficient determined according to the value of the voltage is k1, and the adjustment coefficient determined according to the value of the current is k2. Then, the adjustment coefficient can be determined as the mean value of the separately determined adjustment coefficients, that is the final adjustment coefficient is (k1+k2)/2. In this way, the adjustment strategy for data signals is more accurate.

Figure 7:
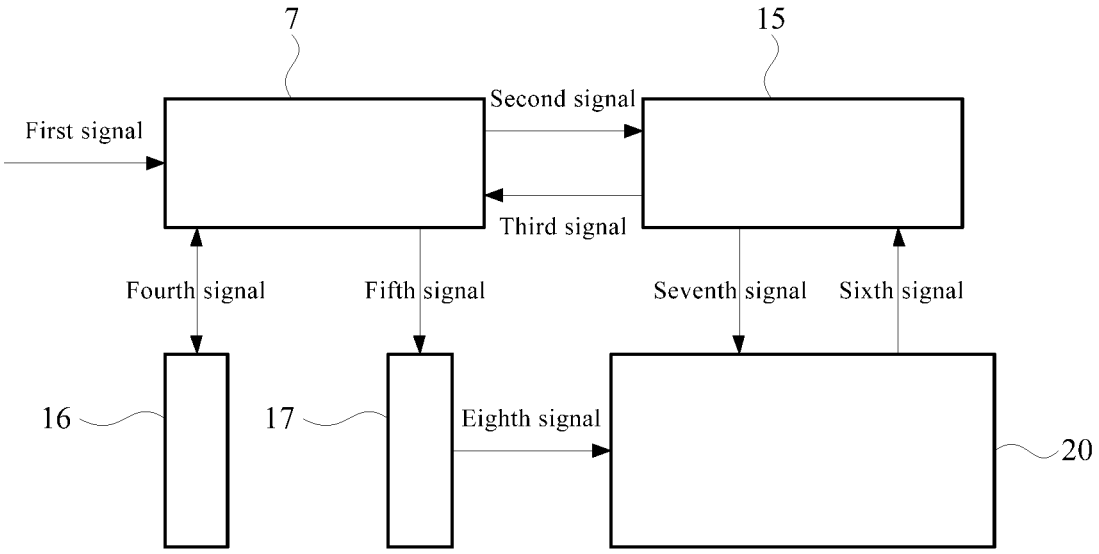
FIG. 7 is a schematic diagram showing a relationship between a timing controller and a display panel according to an arrangement of the present disclosure.

FIG. 7 is a schematic diagram showing the relationship between a timing controller and a display panel according to an arrangement of the present disclosure.

As shown in FIG. 7, the timing controller 7 can be electrically connected to the display panel 20 provided with the compensation circuit as described the above arrangements through a source driver 15. A first signal input to the timing controller 7 can include a timing control signal Timing and a brightness control signal RGB. A second signal input to the source driver 15 by the timing controller 7 may include a data signal Data and a source control signal SCS. A third signal input from the source driver 15 to the timing controller 7 may include a data voltage value Sense, and a value of the current CDD. A fourth signal input from the storage device 16 to the timing controller 7 may include the theoretical value $I_T$, and may also include data written by the timing controller 7 to the storage device 16. A fifth signal input from the timing controller 7 to a gate driver 17 may include a gate control signal GCS. An eighth signal input from the gate driver 17 to the display panel 20 may include signals input to the first gate line and the second gate line.

FIG. 8 is a schematic structural diagram of a timing controller according to an arrangement of the present disclosure.

As shown in FIG. 8, the timing controller 7 includes a brightness conversion unit 71, an algorithm compensation unit 72, a data conversion unit 73, and a timing conversion unit 74. The controller 7 may be a timing controller (TCON), for example.

The brightness conversion unit 71 can receive the brightness control signal RBG, and convert the brightness control signal into a brightness signal LRGB and input it into the algorithm compensation unit 72. The algorithm compensation unit 72 can receive the data voltage value Sense in addition to the brightness signal LRGB, and can obtain the data signal Data' by processing the LRGB and Sense using algorithms, such as an RGB-RGBW algorithm, a peak luminance algorithm, a color complementation algorithm, a TFT eigenvalue compensation algorithm, an OLED eigenvalue compensation algorithm, an optical compensation algorithm. The data signal Data' can be input to the data conversion unit 73.

Further, the data conversion unit 73 can read the theoretical value $I_T$ in the storage device, and receive the value CDD of the current, and perform comparisons and calculations (for example, the operation of determining k as described above) to obtain the adjusted data signal Data by taking Sense and CDD into account, and output the adjusted data into the source driver.

On the other hand, the timing conversion unit 74 can generate the source control signal SCS and the gate control signal GCS according to the timing control signal Timing, and output the generated signals to the source driver and the gate driver, respectively.

In the present disclosure, the controller 7 may be implemented by ASIC (Application Specific Integrated Circuit), and the brightness conversion unit 71, the algorithm compensation unit 72, the data conversion unit 73, and the timing conversion unit 74 may be constituting circuits or ASICs. Alternatively, the controller 7 may be implemented by a combination of hardware and software. For example, the controller 7 may be implemented by a processor and a memory for storing instructions, and the processor executes the instructions in the memory to perform the functions of the units 71 to 74 in the controller 7.

It should be noted that the foregoing arrangements may be combined with each other if no conflict occurs. For example, the arrangement shown in FIG. 5 can also be applied to the arrangement shown in FIG. 2 (that is, the reference voltage input terminal can also be set in the arrangement as shown in FIG. 2). Specific combinations of arrangements can be selected according to actual needs.

An arrangement of the present disclosure also provides a display panel including the compensation circuit described in any of the above arrangements.

An arrangement of the present disclosure also provides a display device including the display panel described in the above arrangement.

It should be noted that the display device in the arrangement may be any product or component having a display function, such as an electronic paper, a mobile phone, a tablet computer, a television, a notebook computer, a digital photo frame, a navigator, and the like.

Figure 9:
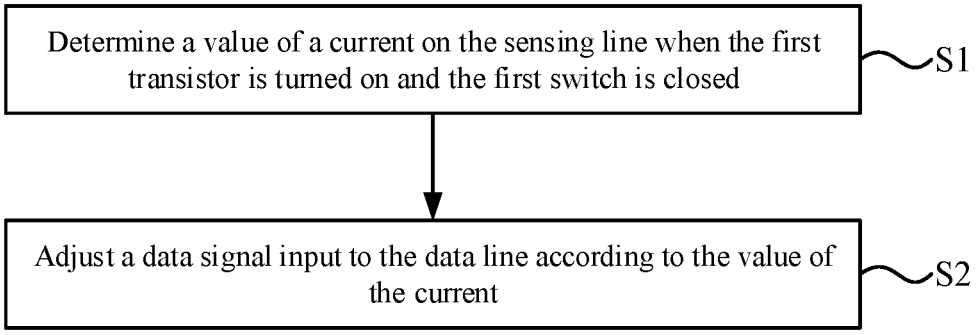
FIG. 9 is an illustrative flow chart of a method for controlling a compensation circuit according to an arrangement of the present disclosure.

FIG. 9 is an illustrative flow chart of a method for controlling a compensation circuit control according to an arrangement of the present disclosure. The compensation circuit control method of the arrangement is used to control the compensation circuit described in any of the above arrangements. As shown in FIG. 9, the control method includes the following blocks.

In block S1, a value of a current on the sensing line when the first transistor is turned on and the first switch is closed is determined.

In block S2, a data signal input to the data line is adjusted according to the value of the current.

Figure 10:
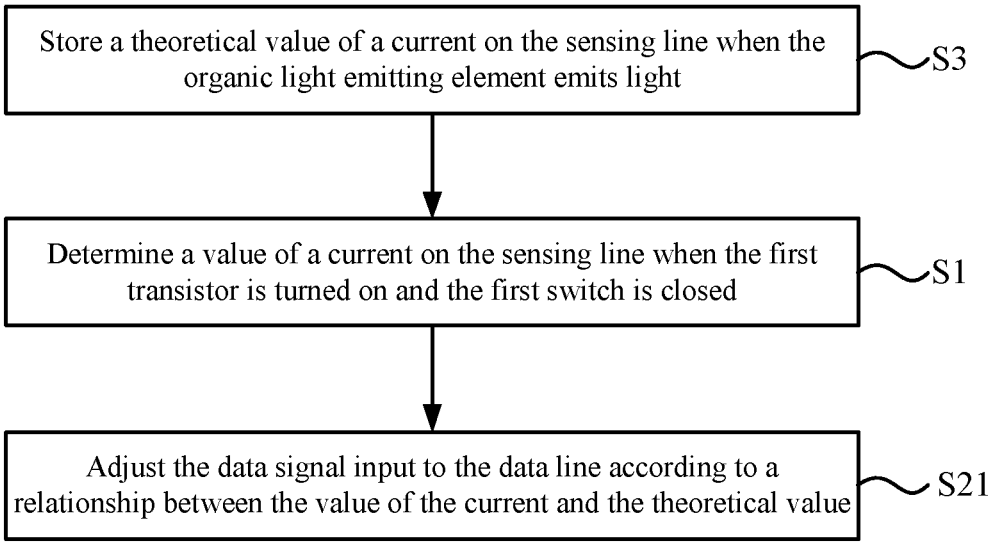
FIG. 10 is an illustrative flow chart of a method for controlling a compensation circuit according to an arrangement of the present disclosure.

FIG. 10 is an illustrative flow chart of a method for controlling a compensation circuit control method according to an arrangement of the present disclosure. As shown in FIG. 10, the control method further includes the following block.

In block S3, a theoretical value of a current on the sensing line when the organic light emitting element emits light is stored. Block S3 may be performed before block S1, or may be performed after block S1, and may be set as needed, as long as block S3 is performed before block S21.

The adjusting the data signal input to the data line, includes block S21, in which the data signal input to the data line is adjusted according to a relationship between the value of the current and the theoretical value.

Figure 11:
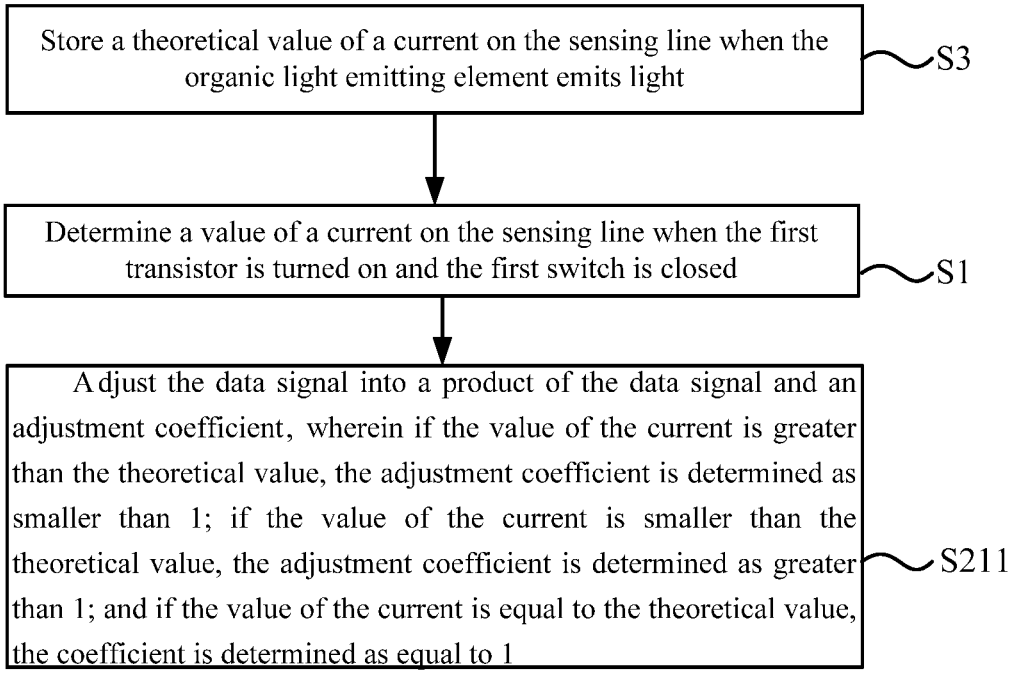
FIG. 11 is an illustrative flow chart of a method for controlling a compensation circuit according to an arrangement of the present disclosure.

FIG. 11 is an illustrative flow chart of a method for controlling a compensation circuit according to an arrangement of the present disclosure. As shown in FIG. 11, the adjusting the data signal input to the data line, includes block S211, in which the data signal is adjusted into a product of the data signal and an adjustment coefficient. If the value of the current is greater than the theoretical value, the adjustment coefficient is determined as smaller than 1; if the value of the current is smaller than the theoretical value, the adjustment coefficient is determined as greater than 1; and if the value of the current is equal to the theoretical value, the coefficient is determined as equal to 1

According to an exemplary arrangement, the adjustment coefficient is equal to a ratio of the theoretical value to the value of the current.

Figure 12:
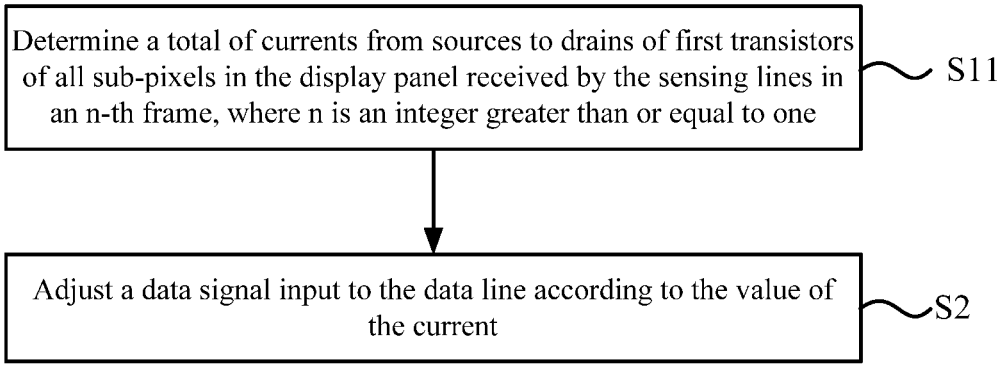
FIG. 12 is an illustrative flow chart of a method for controlling a compensation circuit according to an arrangement of the present disclosure.

FIG. 12 is an illustrative flow chart of a method for controlling a compensation circuit according to an arrangement of the present disclosure. As shown in FIG. 12, the compensation circuit includes a plurality of the sensing lines, each of the sensing lines corresponds to a column of the sub-pixels and is configured to receive a current from the source to the drain of the first transistor in any one of the sub-pixels in a corresponding column of sub-pixels.

The determining the value of the current on the sensing line includes block S11, in which a total of currents from sources to drains of first transistors of all sub-pixels in the display panel received by the sensing lines in an n-th frame is determined, where n is an integer greater than or equal to one.

Figure 13:
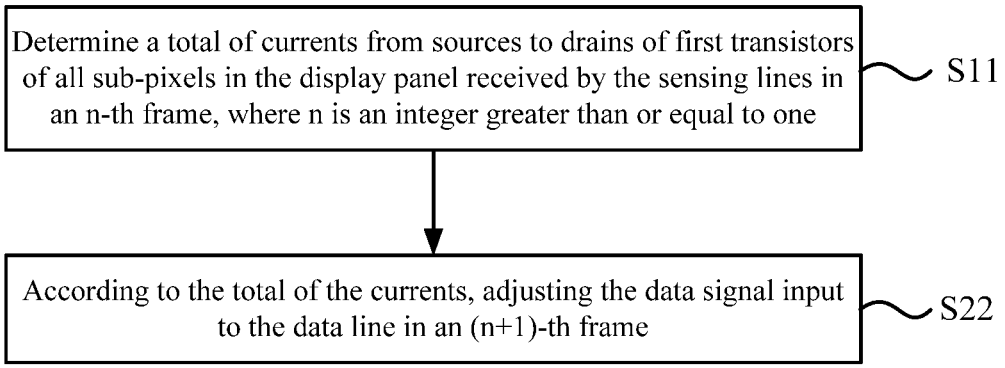
FIG. 13 is an illustrative flow chart of a method for controlling a compensation circuit according to an arrangement of the present disclosure.

FIG. 13 is an illustrative flow chart of a method for controlling a compensation circuit according to an arrangement of the present disclosure. As shown in FIG. 13, the adjusting a data signal input to the data line according to the value of the current, includes block S22, in which the data signal input to the data line in an (n+1)-th frame is adjusted according to the total of the currents.

Figure 14:
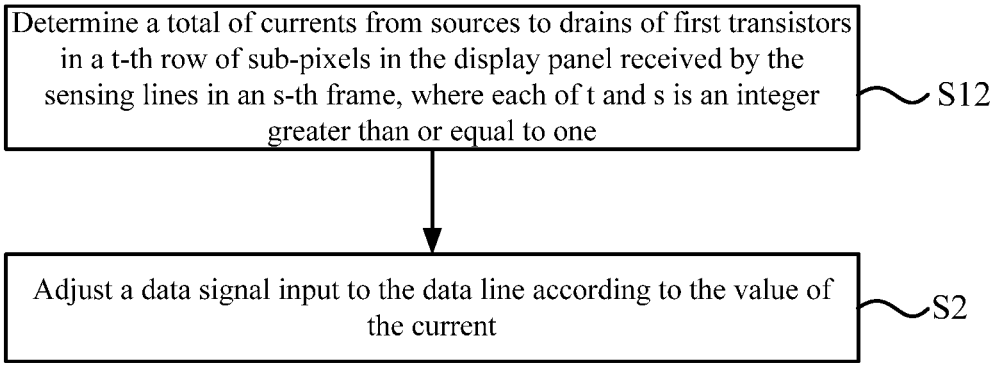
FIG. 14 is an illustrative flow chart of a method for controlling a compensation circuit according to an arrangement of the present disclosure.

FIG. 14 is an illustrative flow chart of a method for controlling a compensation circuit according to an arrangement of the present disclosure. As shown in FIG. 14, the compensation circuit includes a plurality of the sensing lines, each of the sensing lines corresponds to a column of the sub-pixels and is configured to receive a current from the source to the drain of the first transistor in any one of the sub-pixels in a corresponding column of sub-pixels.

The determining the value of the current on the sensing line includes block S12, in which a total of currents from sources to drains of first transistors in a t-th row of sub-pixels in the display panel received by the sensing lines in an s-th frame is determined, where each oft and s is an integer greater than or equal to one.

Figure 15:
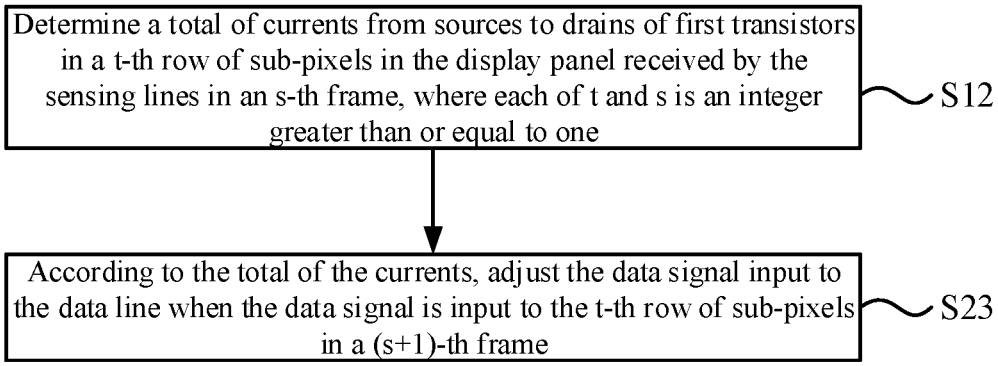
FIG. 15 is an illustrative flow chart of a method for controlling a compensation circuit according to an arrangement of the present disclosure.

FIG. 15 is an illustrative flow chart of a method for controlling a compensation circuit according to an arrangement of the present disclosure. As shown in FIG. 15, the adjusting a data signal input to the data line according to the value of the current, includes block S23. The block 23, according to the total of the currents, adjusts the data signal input to the data line when the data signal is input to the t-th row of sub-pixels in a (s+1)-th frame.

Figure 16:
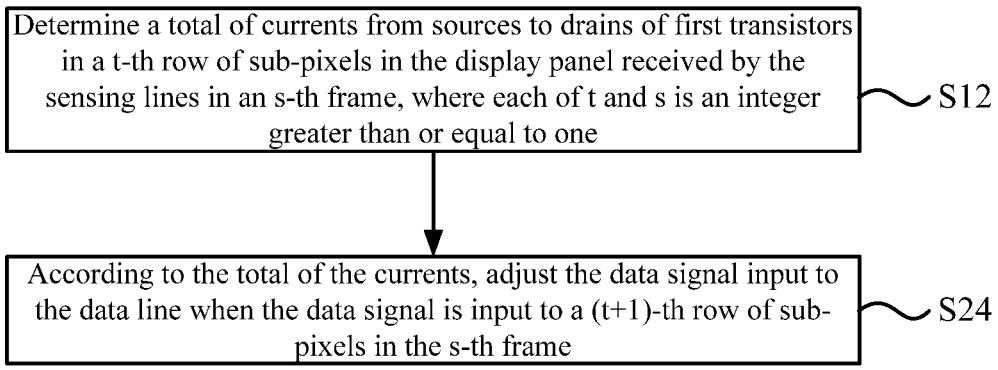
FIG. 16 is an illustrative flow chart of a method for controlling a compensation circuit according to an arrangement of the present disclosure.

FIG. 16 is an illustrative flow chart of a method for controlling a compensation circuit according to an arrangement of the present disclosure. As shown in FIG. 16, the adjusting a data signal input to the data line according to the value of the current, includes block S24. The block S24, according to the total of the currents, adjusts the data signal input to the data line when the data signal is input to a (t+1)-th row of sub-pixels in the s-th frame.

Figure 17:
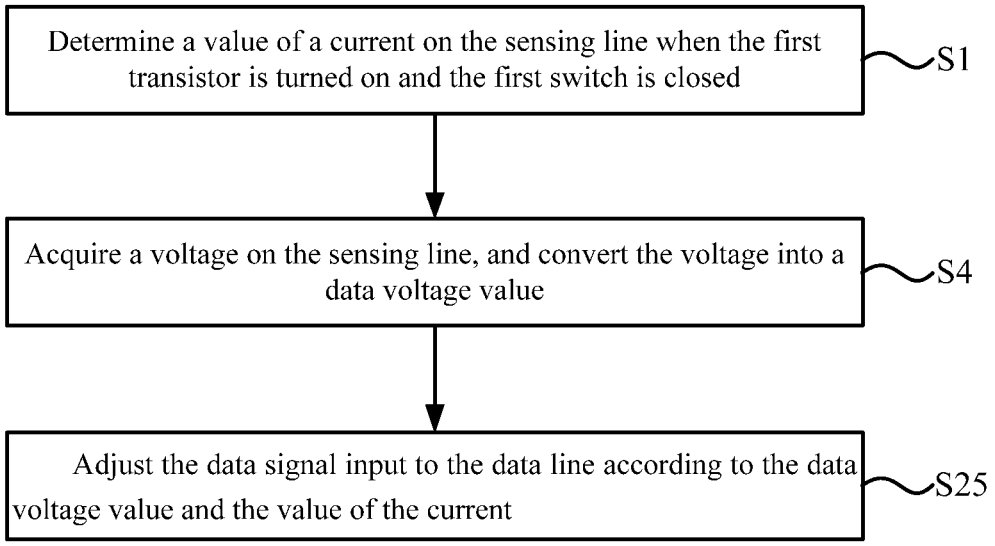
FIG. 17 is an illustrative flow chart of a method for controlling a compensation circuit according to an arrangement of the present disclosure.

FIG. 17 is an illustrative flow chart of a method for controlling a compensation circuit according to an arrangement of the present disclosure. As shown in FIG. 17, the compensation circuit further includes a second switch electrically connected to the sensing line. The control method further includes the following block.

In block S4, the voltage on the sensing line is obtained, and the voltage is converted into a data signal. Block S4 may be performed before block S1, or may be performed after block S1, and may be set as needed, as long as block S4 is performed before block S25.

The adjusting the data signal input to the data line according to the value of the current includes block S25.

In block S25, the data signal input to the data line is adjusted according to the data signal and the value of the current.

In the present disclosure, the terms "first", "second" and the like are used for descriptive purposes only, and are not to be construed as indicating or implying relative importance. The term "plurality" refers to two or more, unless specifically defined otherwise.

Other arrangements of the present disclosure will be apparent to those skilled in the art. The present disclosure is intended to cover any variations, uses, or adaptations of the present disclosure, which are made in accordance with the general principles of the present disclosure and include common general knowledge or common technical means in the art that are not disclosed herein. The descriptions and examples are to be considered as illustrative only. The scope of the present disclosure is defined by appended claims.

It is to be understood that the present disclosure is not limited to the precise structures shown and described in the drawings, and various modifications and changes can be made without departing from the scope of the present disclosure. The scope of the present disclosure is limited only by the appended claims.

What is claimed is:

1. A method for controlling a compensation circuit, comprising:

providing the compensation circuit, wherein the compensation circuit is applicable for a display panel comprising a plurality of pixels, each pixel comprising a plurality of sub-pixels, wherein each sub-pixel comprises a first transistor, a gate of the first transistor is electrically connected to a data line, a source of the first transistor is electrically connected to a voltage input end, and a drain of the first transistor is electrically connected to an organic light emitting element, wherein the compensation circuit comprises:

a sensing line for receiving a current flowing from the source to the drain of the first transistor when the organic light emitting element is emitting light;

a first switch having a terminal electrically connected to the sensing line;

a current sensor electrically connected to another terminal of the first switch and configured to determine a value of the current received on the sensing line when the first transistor is turned on and the first switch is closed; and a controller electrically connected to the current sensor and the data line for adjusting a data signal input to the data line according to the value of the current;

determining a value of a current on the sensing line when the first transistor is turned on and the first switch is closed; and adjusting the data signal input to the data line according to the value of the current;

wherein the sensing line and the data line are two different lines;

wherein the compensation circuit comprises a plurality of sensing lines, each of the sensing lines corresponds to a column of the plurality of sub-pixels and is configured to receive the current flowing from the source to the drain of the first transistor in one of the plurality of sub-pixels in the corresponding column;

wherein determining the value of the current on the sensing line comprises determining a total of currents respectively flowing from sources to drains of transistors in a t-th row of the plurality of sub-pixels in the display panel received by the sensing lines in an s-th frame, where each oft and s is an integer greater than or equal to one.

2. The method according to claim 1, further comprising:

storing a theoretical value of the current received on the sensing line when the organic light emitting element emits light;

wherein adjusting a data signal input to the data line according to the value of the current, comprises: adjusting the data signal input to the data line according to a relationship between the value of the current and the theoretical value.

3. The method according to claim 2, wherein the adjusting the data signal input to the data line, comprises:

adjusting the data signal into a product of the data signal and an adjustment coefficient;

wherein if the value of the current is greater than the theoretical value, the adjustment coefficient is determined as smaller than 1; if the value of the current is smaller than the theoretical value, the adjustment coefficient is determined as greater than 1; and if the value of the current is equal to the theoretical value, the coefficient is determined as equal to 1.

4. The method according to claim 1, wherein the adjusting the data signal input to the data line according to the value of the current, comprises:

according to the total of the currents, adjusting the data signal input to the data line when the data signal is input to the t-th row of the plurality of sub-pixels in a (s+1)-th frame.

5. The method according to claim 1, wherein the adjusting the data signal input to the data line according to the value of the current, comprises:

according to the total of the currents, adjusting the data signal input to the data line when the data signal is input to a (t+1)-th row of sub-pixels in the s-th frame.

6. The method according to claim 1, wherein the compensation circuit further comprises a second switch which is electrically connected to the sensing line, wherein the method comprises:

acquiring a voltage on the sensing line, and converting the voltage into a data voltage value;

wherein the adjusting the data signal input to the data line according to the value of the current, comprises: adjusting the data signal input to the data line according to the data voltage value and the value of the current.

7. A compensation circuit applicable for a display panel comprising a plurality of pixels, each pixel comprising a plurality of sub-pixels, wherein each sub-pixel comprises a first transistor, a gate of the first transistor is electrically connected to a data line, a source of the first transistor is electrically connected to a voltage input end, and a drain of the first transistor is electrically connected to an organic light emitting element;

wherein the compensation circuit comprises:

a sensing line for receiving a current flowing from the source to the drain of the first transistor when the organic light emitting element is emitting light;

a first switch having a terminal electrically connected to the sensing line;

a current sensor electrically connected to another terminal of the first switch and configured to determine a value of the current received on the sensing line when the first transistor is turned on and the first switch is closed; and a controller electrically connected to the current sensor and the data line for adjusting a data signal input to the data line according to the value of the current;

wherein the sensing line and the data line are two different lines;

wherein the compensation circuit further comprises:

a storage device electrically connected to the controller for storing a theoretical value of the current on the sensing line when the organic light emitting element emits light; and wherein the controller is configured to adjust the data signal input to the data line according to a relationship between the value of the current and the theoretical value;

wherein the controller is configured to adjust the data signal into a product of the data signal and an adjustment coefficient;

wherein if the value of the current is greater than the theoretical value, the adjustment coefficient is determined as smaller than 1; if the value of the current is smaller than the theoretical value, the adjustment coefficient is determined as greater than 1, and if the value of the current is equal to the theoretical value, the coefficient is determined as equal to 1.

8. The compensation circuit of claim 7, wherein the controller comprises:

a brightness conversion circuit configured to receive a brightness control signal and convert the brightness control signal into a brightness signal;

an algorithm compensation circuit configured to receive the brightness signal and obtain a data signal based on the brightness signal and the value of the current; and a data conversion circuit configured to read the theoretical value, receive the value of the current, and adjust the data signal to be input to the data line according to the relationship between the value of the current and the theoretical value.

9. The compensation circuit of claim 7, wherein:

the compensation circuit comprises a plurality of the sensing lines, each of the plurality of sensing lines corresponds to a column of the plurality of sub-pixels and is configured to receive the current flowing from the source to the drain of the first transistor in one of the plurality of sub-pixels along the corresponding column; and the current sensor is electrically connected to each of the plurality of sub-pixels for determining a total of currents respectively flowing from sources to drains of transistors of the plurality of sub-pixels in the display panel received by sensing lines in an n-th frame, where n is an integer greater than or equal to one.

10. The compensation circuit of claim 7, wherein:

the compensation circuit comprises a plurality of the sensing lines, each of the sensing lines corresponds to a column of the plurality of sub-pixels and is configured to receive the current flowing from the source to the drain of the first transistor in one of the plurality of sub-pixels along the corresponding column; and the current sensor is electrically connected to each of the plurality of sub-pixels for determining a total of currents respectively flowing from sources to drains of transistors in a t-th row of the plurality of sub-pixels in the display panel received by the sensing lines in an s-th frame, where each oft and s is an integer greater than or equal to one.

11. The compensation circuit of claim 7, wherein the compensation circuit further comprises a reference voltage input terminal electrically connected to the current sensor for inputting a reference voltage to the current sensor.

12. The compensation circuit of claim 7, wherein the compensation circuit further comprises:

a second switch electrically connected to the sensing line; and an analog-to-digital converter electrically connected to the second switch, wherein when the second switch is closed, the analog-to-digital converter is configured to acquire a voltage on the sensing line, and converts the voltage into a data voltage value;

wherein the controller is further electrically connected to the analog-to-digital converter, and is configured to adjust the data signal input to the data line according to the data voltage value and the value of the current.

13. The compensation circuit of claim 7, wherein each sub-pixel further comprises:

a second transistor, wherein a gate of the second transistor is electrically connected to a first gate line, a source of the second transistor is electrically connected to the data line, and a drain of the second transistor is electrically connected to the gate of the first transistor;

a third transistor, wherein a gate of the third transistor is electrically connected to a second gate line, a source of the third transistor is electrically connected to a connection node where the organic light emitting element is connected to a capacitor, wherein the capacitor is connected between the gate and the drain of the first transistor; and wherein the sensing line is electrically connected to a drain of the third transistor.

14. A display device, comprising:

a compensation circuit, wherein the compensation circuit is applicable for a display panel comprising a plurality of pixels, each pixel comprising a plurality of sub-pixels, wherein each sub-pixel comprises a first transistor, a gate of the first transistor is electrically connected to a data line, a source of the first transistor is electrically connected to a voltage input end, and a drain of the first transistor is electrically connected to an organic light emitting element;

wherein the compensation circuit comprises:

a sensing line for receiving a current flowing from the source to the drain of the first transistor when the organic light emitting element is emitting light;

a first switch having a terminal electrically connected to the sensing line;

a current sensor electrically connected to another terminal of the first switch and configured to determine a value of the current received on the sensing line when the first transistor is turned on and the first switch is closed; and a controller electrically connected to the current sensor and the data line for adjusting a data signal input to the data line according to the value of the current;

wherein the sensing line and the data line are two different lines;

wherein the compensation circuit further comprises:

a storage device electrically connected to the controller for storing a theoretical value of the current on the sensing line when the organic light emitting element emits light; and wherein the controller is configured to adjust the data signal input to the data line according to a relationship between the value of the current and the theoretical value;

wherein the controller is configured to adjust the data signal into a product of the data signal and an adjustment coefficient;

wherein if the value of the current is greater than the theoretical value, the adjustment coefficient is determined as smaller than 1; if the value of the current is smaller than the theoretical value, the adjustment coefficient is determined as greater than 1, and if the value of the current is equal to the theoretical value, the coefficient is determined as equal to 1.

* * * * *